US007111472B1

(12) United States Patent
Cloud

(10) Patent No.: US 7,111,472 B1
(45) Date of Patent: Sep. 26, 2006

(54) CIRCUIT APPARATUS AND CONFIGURATIONS FOR REFRIGERATION SYSTEMS

(75) Inventor: Richard L. Cloud, Louisville, KY (US)

(73) Assignee: Tube Ice, LLC, Louisville, KY (US)

( * ) Notice: Subject to any disclaimer, the term of this patent is extended or adjusted under 35 U.S.C. 154(b) by 0 days.

(21) Appl. No.: 08/983,332

(22) PCT Filed: Apr. 4, 1997

(86) PCT No.: PCT/US97/06818

§ 371 (c)(1),
(2), (4) Date: Mar. 5, 1998

(87) PCT Pub. No.: WO97/38269

PCT Pub. Date: Oct. 16, 1997

Related U.S. Application Data

(60) Provisional application No. 60/014,833, filed on Apr. 4, 1996.

(51) Int. Cl.
*F25B 19/00* (2006.01)

(52) U.S. Cl. ..... 62/278; 62/503; 62/81; 62/498; 62/513

(58) Field of Classification Search ..... 62/278, 62/503, 81, 498, 513
See application file for complete search history.

(56) References Cited

U.S. PATENT DOCUMENTS

| | | | | | |
|---|---|---|---|---|---|
| 534,859 | A * | 2/1895 | Cook et al. | ..... | 62/513 |
| 2,270,934 | A * | 1/1942 | Dickieson | ..... | 62/513 |
| 2,983,112 | A * | 5/1961 | Batteiger | ..... | 62/156 |
| 3,423,954 | A * | 1/1969 | Harnish et al. | ..... | 62/222 |
| 4,217,765 | A * | 8/1980 | Ecker | ..... | 62/503 |
| 4,266,405 | A * | 5/1981 | Trask | ..... | 62/160 |

* cited by examiner

*Primary Examiner*—Cheryl J. Tyler
(74) *Attorney, Agent, or Firm*—Wyatt, Tarrant & Combs, LLP

(57) ABSTRACT

The proposed design describes a refrigeration system with an evaporator, which allows inherent absorption of heat from the ambient, a condenser returning refrigerant to a liquid state, a compressor delivering refrigerant within the system but with refrigerant flowing through a heat exchanger from the compressor to the receiver and flowing through such a heat exchanger parallel to the flow of low pressure gas leaving the evaporator in a vertical configuration which precludes the flow of liquid from the evaporator to the compressor but maintains the constant pressures and constant flow of refrigerant within the heat exchanger to maximize the efficiency of the system.

5 Claims, 11 Drawing Sheets

No. 1 - 7 illustrate the flow of refrigerant starting at the compressor discharge.

CIRCUIT APPARATUS AND CONFIGURATIONS FOR REFRIGERATION SYSTEMS

This is a provisional application of No. 60/014,833, Apr. 4, 1996.

TECHNICAL FIELD

This invention relates to the conduit circuitry by which refrigerant is carried within a refrigeration system, specifically, the design calls for an apparatus, the layout for which provides parallel flow within a heat exchanger in a vertical configuration to achieve greater heat transfer efficiency in refrigeration, a non-traditional conduit piping between the various components of such a system, which eliminates the need of certain components, produces gains of increased efficiency with reduced failures of the compressor motor, and reduces the potential for exposure of refrigerant to the atmosphere promoting safety and environmental suitability of otherwise desirable refrigerants.

DESCRIPTION OF THE PRIOR ART

Refrigeration is the cooling of a space or its content to a lower value than that of the surrounding space or of the ambient atmosphere. Until the arrival of modern technology, natural ice was the only means of refrigeration. Ice acts as an efficient refrigerant because the temperature of melting ice remains at 32° F. It continuously absorbs heat from warmer surroundings by cooling them while not itself becoming warmer unfit completely melted. The demand for ice created a strong impetus for inventors to develop artificial cooling methods.

Refrigeration takes place when heat flows to a receiver colder thatn its surroundings. In the vapor-compression system the heat receiver is call an evaporator. Liquid refrigerant boils in it at a controlled temperature, absorbing heat to create the desired cooling. The warmed vapor from the evaporator is then compressed and pumped outside the refrigerated space. When the pressure is raised it is condensed and cooling water or air carries away teh excess heat. The liquid refrigerant then enters an expansion valve that causes the pressure to drop, and the cycle repeats itself when the refrigerant boils in the evaporator. Two basic pressures exist: a low one that sets the desired refrigerating temperature, and a high one that sets a condensation temperature sufficiently high to dissipate heat.

By adjusting the volumeric capacity of the compressor to match the refrigeration needed in the evaporator, a wide range of evaporator pressures (temperature) can be obtained. It should be noted that within all refrigeration and air-conditioning systems, superheat which is the temperature of the refrigernat above it's saturation point at a given pressure at the evaporator, should be in a range of 8 to 12° F.

The early realization that temperature at which evaporation occurs can be controlled by varying pressure and that a volatile liquid absorbs heat when it evaporates prompted the development of circuitry containing refrigerant to cool its surroundings. The first recorded instance of this application being used for cooling was developed at the University of Glasgow in 1748 by William Cullen, who evaporated ethyl ether under subatmospheric pressure to produce refrigeration. The process was successful but, was not continuous and never advanced much beyond the laboratory stage.

A patent established in 1834 in London, by American Jacob Perkins, established the first practical ice making machine, a volatile liquid refrigerator using a compressor in a closed cycle circuit which conserved the fluid for reuse. In 1844 John Genie, of the United States, developed the first successful refrigeration system using a non-vola(die liquid with a basic compression-expansion process and was awarded U.S. Pat. No. 8,080 in 1851. The refrigerating principle was extensively used during the latter part of the 19th century and during the early years of the 20th century.

Another type of refrigeration unit, the absorption-type machine, was developed by Ferdinand Carre in France by 1850. This process can operate exclusively by burning natural gas or other fuels, was commonly used before the widespread availability of electricity. The first machines of this type used water as a refrigerant and sulfuric acid as an absorbent, however in 1859, Carre switched to an ammonia-water system that is still in use in certain applications.

These examples of prior art are referred to here rather than specifically addressed in the discussions of prior arts which follow as they provide no insight as to the subsequent development of the art towards goals of overcoming limitations. As is appropriate given the state of the art, discussions of the prior arts focus on the prior attempts reconcile limitations in the mechanics of refrigeration: these earliest arts only established that refrigeration could occur and be controlled on a fundamental level. The basic concepts underlying modern day refrigeration were in place by 1860. However the continuing problem to the present day has been mainly to development more efficient systems and better refrigerants, and to modify each to the refrigeration requirements necessitated by many new and different applications.

Ice manufacturing as an early aspect of the fledgling refrigeration industry, followed closely by its introduction to cold-storage facilities, breweries, and refrigerated railway and ship transport. Starting in the early 1900's but more rapidly after 1910, air conditioning for comfort and for industrial use became significant. After World War I, particularly in the 1920's, the domestic refrigerator began to replace the icebox. After World War II, the use of air conditioning became widespread for residential and commercial comfort. The use of refrigeration for comfort shows no sign of diminishing, and the market for its products is far from saturation when considering our global markets of today.

With the widespread use of mechanical refrigeration in homes, the development of a frozen-food industry became possible, this area also continues to grow at a rapid pace. As more products are developed for frozen delivery, the need for refrigeration continues to grow. Industrial uses of refrigeration are greatest in the areas of food storage and distribution. The chemical industry also uses refrigeration in enormous amounts in such areas as process control, separation of chemicals, petrochemical manufacture, and liquefaction of gases.

A refrigeration system includes, essentially, an evaporator which promotes the absorption of heat from an outside medium by a refrigeration create a cooling effect, an expansion devise at the inlet to the evaporator which reduces pressure of the incoming refrigerant setting up the evaporation/absorption process, a condenser which allows the refrigerant to return from a gaseous state to liquid so that it may be reused to absorb heat again and a compressor to deliver the refrigerant from the evaporator to the condenser and back again. The system functions by absorbing heat in a controlled manner to achieve the desired refrigeration effect, and rejecting the absorbed heat away from the area where the effect is sought. The media for this absorption/rejection process are chosen because of natural molecular efficiencies of those certain chemicals under controlled conditions.

With the increased efficiency of certain refrigerants has come difficulties with regard to environmental effects requiring the use of alternate, less efficient, refrigerants. Materials such as ethyl alcohol and sulfur dioxide were first used as refrigerants but after 1850, ammonia became the refrigerant of choice. Though irritating and somewhat toxic, it did offer a great improvement and is still widely used in industrial refrigeration today. The need for a safe chemical for a vapor-compression system which would be stable, incombustible, nontoxic, and nonirritating became paramount with the rapidly expanding commercial and residential markets.

Led by Thomas Tidgley Jr., a team of researchers discovered in 1930 that, by positioning chlorine and fluorine atoms in certain places in hydrocarbon compounds, they could make suitable refrigerants. Thomas Tidgley, Jr. Albert R. Henne and Robert McNary were awarded U.S. Pat. No. 1,833,847 for their development of this refrigerant. These halogenated hydrocarbons, or halocarbons, were developed under the DuPont trademark FREON®. Since then, others familiar refrigerants have been developed. Freon-12 and similar refrigerants are now commonly known as Refrigerant-12 which, along with Freon-22 and other similar Refrigerant-22, are the most common and widely used refrigerants in the world today, A fluorocarbon (a an organic chemical that has one or more fluorine atoms and over one hundred fluorocarbons have been classified; because a hydrogen atom in any hydrocarbon may be substituted by a fluorine atom, the list of potential fluorocarbons is virtually endless. While certain fluorocarbons, such as refrigerant 12 and Refrigerant-22, offer high efficiency, these fluorocarbons are not without limitations.

In 1988, due to atmospheric ozone layer depletion, the DuPont Company and Dow Chemical, major producers of refrigerants, agreed with the EPA and some 100 other counties to phase out CFC refrigerants under the Montreal Protocol Act. In doing so, alternate blends have been emerging in the market place, including, for example, ones under the DuPont trademark name SUVA. Though offering both a nontoxic and environmental safe compound refrigerant, the blends have experienced an unfortunate reduction in performance in capacity.

The subject design addresses that reduced capacity of a systems performance with a startling increase in capacity (BTU) as well as decrease in power consumption ranging from 16–30%. Thus, the needs of the environmentally-friendly refrigeration system are met rather than accepted as a compromise in a world increasingly demanding maximum work for energy expended.

The current state of the art requires additional components providing certain functions to maintain operation under imperfections of the design: that is to say that the art has evolved to require inclusion of a suction accumulator which holds refrigerant before the evaporator to maintain the liquid level, a heat exchanger to provide a source to heat from the refrigerant leaving the evaporator, a receiver to accumulate the liquid leaving the condenser where the demand downstream is reduced, and a thermal expansion device, a mechanical control or mechanical control or other control to adjust the amount of liquid being introduced to the evaporator.

Of primary concern is a problem with liquid being introduced into the compressor resulting in compressor failure. Common practice in refrigeration systems is to protect the compressor from liquid refrigerant slugs by placing a suction accumulator and/or heat exchanger in the suction line returning to the compressor. These devices are commonly piped as shown in FIG. 1.

Additionally, inefficiencies in the scaling of the various components, coupled with inconsistent demand and load, creates a need for a throttling mechanism. This mechanism maintains the maximum efficiency of a high liquid level in the evaporator without allowing flooding of the evaporator which, while allowing a higher level of heat absorption, risks slugging, the introduction of liquid to the compressor. During operation, liquid refrigerant returning from the condenser is stored in the receiver. As liquid is needed in the evaporator, opening the thermal expansion valve allows it to flow from the receiver, through the heat exchanger (which may also act as a suction accumulator for the low pressure side of the system) and then into the evaporator. One method to combine heat transfer with accumulation of low pressure liquid in staging prior to introduction to the compressor is to locate a coil inside the suction accumulator as shown in FIG. 2. Within the heat exchange location, the warm liquid from the condenser transfers its hat across the heat exchange surface to the suction gas, vaporizing any remaining liquid droplets or slugs in the suction vapor. This acts to safeguard against liquid, which may have failed to evaporate in the evaporator, from flowing on to the compressor. It is common in the art to use a heat exchanger alone, an accumulator alone (with or without internal coil), or a combination of both devices, depending on the severity of liquid carryover expected.

These ancillary components and revisions to the basic design relate to two problems: one, that the compressor may not accept liquid refrigerant (and thus the design must prevent refrigerant in a nongaseous state from returning to the compressor; and second, that the evaporator operates most efficiently with a higher level of liquid within (and thus, maintaining a high level of liquid maximizes the absorption of heat). There is an inherent conflict in these two goals which must be resolved or compromised in that raising the level of heat absorbing liquid in the evaporator raises the risk that nonevaporated liquid will spill over into the compressor. Thus, the overview of the prior arts shows a constantly evolving balancing act.

Distinction Between Ice-Making and Refrigeration

While the process of refrigeration discussed above serves the ability to chill air for refrigeration and comfort under the same principle as ice-making, ice-making introduces water to the evaporator which then adheres to the chilling surfaces. Air and chilled water can be simply moved away by means such as a blower or gravity. Ice, when formed, however, must be harvested by melting the chilling surface to initiate melting. While this can be accomplished with other means, such as electric resistance coils, a source of heat which is readily available is the hot gas, compressed in the compressor or hot liquid after leaving the condenser. This approach is simpler in that the same mechanics can provide two functions.

U.S. Pat. No. 2,121,253 calls for a refrigerant circuit wherein refrigerant flows from the compressor to a condenser to a receiver to a heat exchange which also serves as an accumulator through the evaporator and back through the accumulator and then to the compressor, The claim for which letters of patent were issued was the development of a heat exchanger, the first component stabilizing the refrigeration process. This art differs significantly from the proposed design in that high pressure liquid leaving the condenser flows directly into the receiver, with no intervening heat exchange. This early design lacked the advantage of the art, introduced subsequently, that a heat exchanger provided preliminary heating of the refrigerant thus reducing the need for excessive evaporator coils. No provision ms made in the early designs or possibly even considered for hot gas defrost or harvest. This design requires an inefficient low level of liquid in the evaporator meaning much of the energy is utilized moving refrigerant around while that refrigerant is not absorbing heat.

U.S. Pat. No. 2,198,258 awarded to Money, 1937 calls for a refrigerant circuit where the refrigerant flows from the compressor, through a condenser to a float mechanism, from the float, through the evaporator and back to the compressor. This early art demonstrates the recognition that a receiver was necessary for the smooth operation of the system; however, in this early art, the receiving function is performed within the compressor housing allowing for no accumulation of liquid prior to introduction to the evaporator. While the receiving function did limit introduction of liquid to the compressor, this art provided no control ever the level of liquid in the evaporator as the float mechanism could only stop the flow of refrigerant but could not reduce it. By its nature, this system was designed with a limited efficiency, a trend remaining in current arts. Additionally, this art includes the use of a float mechanism which allows excess flow of refgerant to the evaporator and permits subcooling where ambient conditions cause more efficient condensation of the high-pressure refrigerant.

Prior Art miating to imperfections of refrigerant U.S. Pat. No. 2,472,729 awarded to Sideli, 1940 calls for a refrigerant circuit wherein refrigerant from a compressor flows through a condenser to an accumulator/heat exchanger and then from the accumulator/heat exchanger to an evaporator and then back through the accumulator at the exchanger returning to the compressor. The refrigerant pipe and refrigerant return pipe are in heat exchange relationship downstream of the condenser. The piping arrangement serves as the medium for heat exchange but also provides a minimal location for receiving liquid and thus no separate receiver is used. This early piping arrangement demonstrates the pattern, still prevalent in today's arts that liquid leaves the condenser is piped counter to the flow of the suction gas to set up the heat exchange relationship. This approach, while providing some heat exchange, suffers in that the rapid short term heat exchange of the counter flow is not truly responsive to the variant loads. Thus, with variant loading of the system or variant ambient temperatures at the condenser and evaporator, the system must be designed at law than optimal efficiency to compensate for incomplete or excessive heat exchange. Also, this design shows an early use of a capillary tube to provide mediation of the flow of liquid to the evaporator. This art differs significantly from the proposed design in that liquid leaving the condenser immediately enters a capillary tube which acts as an expansion device. There is no receiver to store warm liquid at high pressure to provide a source of warm flash gas for defrost or harvest. The nature of the capillary tube design is that the receiver function is provided both in the capillary tube and the excess capacity of an oversized condenser but that no provision can then be made available to divert hot gas directly to the evaporator to provide defrost. For purposes of its ability to defrost the system or harvest ice, this shortcoming requires an external heat source adding requisite complexity but reducing efficiency since additional heat produced by that heat source must also be rejected from the system in addition to its regular rejection of the heat absorbed in the refrigeration process. This art is unable to vary the level of superheating in the evaporator and must therefore allow for reduced level of liquid.

U.S. Pat. No. 2,500,778 awarded to Tobey, 1947 is for moving the refrigerant from the condenser into a heat exchanger against the flow of refrigerant return from the compressor. While this feature may seem similar to the suction heat exchanger of the proposed design, it is important that this early art differs significantly from the proposed design in that no receiver is provided for storing high pressure liquid refrigerant, which requires necessary oversizing of the evaporator to maintain a low level of liquid. In essence, the condenser provides the receiver function and must therefore be oversized to accommodate the condensing function along with the receiving/storage function. Inherent in the art lacking a receiver is that no provision can be made or considered for supplying hot gas for defrost or harvest. While this early art demonstrates that refrigeration can occur without a separate receiver, the use of condenser to store liquid limits Rays efficiency to reject heat. The primary object of this art appears to be the use of a control and bypass to limit liquid within the evaporator, an inefficiency allowing evaporation (albeit a reduced amount) away from the intended heat source. It must also be noted that this art calls for use of a volatile refrigerant, an unacceptable risk in current uses. Lastly, use of a bellows allows a pressure drop, due to the bellows serving as a venturi/vessel, which introduces inefficiency.

U.S. Pat. No. 2,521,040 awarded to Casette, 1945 calls for placing the condenser downstream of the compressor such that the refrigerant from the compressor goes to a heat exchanger against the refrigerant from the evaporator before flowing to a receiver. While this feature may seem similar to the auction heat exchanger of file proposed design, this art differs significantly from the proposed design in that hot discharge gas from the compressor (rather than the condensed liquid) is brought into direct heat exchange relationship with the suction line. Unlike the proposed design, this excessively warms the suction gas, causing compressor capacity to be used to recirculate heat within the system rather than reject it to the environment. This early art limits the efficiency of rejecting heat which is a necessary condition for the subsequent absorption of heat. Additionally, this art neither provides nor allows provision for supplying hot gas for defrost or harvest. This art requires a minimal level of liquid in the evaporator to prevent slugging and thus provides a corresponding minimal level of efficiency.

U.S. Pat. No. 2,549,747 calls for the use of water heat exchanger as wall as refrigerant-to-refrigerant heat exchanger within in the evaporator. This art shows the conventional arrangement in which liquid leaving the receiver feeds through a suction heat exchanger, conducting this liquid against the suction gas in a heat exchange. Discharge gas from the compressor is condensed and stored in a combination condenser/receiver, again requiring an inefficient sizing of the condenser to provide the additional function of receiving/storing condensed liquid refrigerant. An arrangement, such as proposed in this disclosure, for moving the receiver downstream from the heat exchange location (with the desired benefit of maintaining constant heat exchange regardless of demand at the evaporator) is not possible where the condenser and receiver are combined in a single unit. This particular ad also suffers from the risk of variant water temperatures affecting the rate of superheating. Additionally, the use of the condenser for the receiver function allows subcooling in periods where the ambient temperature is reduced (e.g. winter).

U.S. Pat. No. 2,637,983 calls for splitting part of the refrigerant conduit downstream from the compressor through a heat exchanger against part of the return conduit from the evaporator. This art differs significantly from the proposed design in that the bulk of high pressure liquid flows directly from the condenser to the receiver, with no provision for exchanging heat between the liquid leaving the condenser and the suction line. Hot gas for defrost or newest is drawn directly off the compressor discharge, rather than from the receiver as is desired in the proposed design. This art suffers from the common use of an oversize heat exchanger to reject heat while the system is operating at less than maximum which heat exchanger introduces otherwise undesirable heat back into the system. This art also suffers from attempts to mix hot gas and condensed liquid to accomplish moderating with variant temperature pressure combinations. This art therefore requires inefficient ovemizing of the heat exchanger.

U.S. Pat. No. 2,691,276 calls for running part of the refrigerant conduit downstream from the condenser through a heat exchanger against part of the refrigerant conduit from the evaporator to the compressor. This art diffem significantly from the proposed design in that no receiver is used, and no provision is made or considered for supplying hot gas for defrost or harvest. This art also suffers from minimum protection afforded by the use of non-condensed hot refrigerant which offers less heat rejection. In order to compensate for the minimum heat rejection and the risk of slugging the compressor, the art requires the use of a lower level of liquid in the evaporator, an inherently less efficient and therefore less desirable approach. This art also allows, by means of the throttling function, a method to limit liquid flow to the evaporator which method reduces the exchange of heat.

U.S. Pat. No. 2,860,494 awarded to Whitsel, 1955 is similar to that of U.S. Pat. No. 2,691,276 (immediately above) wherein the refrigerant conduit from the condenser and the return refrigerant conduit are in heat exchange contact in the area. While this may seem similar to the suction heat exchanger of the proposed design, this art diffem significantly from the proposed design in that no receiver is used, and no provision is made or considered for supplying hot gas for defrost or harvest. Since a capillary is placed immediately at the exit of the condenser, a receiver could not be placed in the system shown and still function as required in the proposed design, Additionally, the essence of using a capillary tube approach in lieu of a receiver in this art is that the art is not suitable for temperature extremes or variant load conditions and must be designed to operate less efficiently to reduce the risk of slugging brought on by a reduced load reducing effective evaporation and allowing liquid to leave the evaporator. This art maintains limited efficiency to minimizing excessive cooling in the refrigeration section.

U.S. Pat. No. 2,871,679 awarded to Zearfoss, Jr., 1955 calls for routing refrigerant from the compressor through a condenser to an accumulator before placement of a heat exchanger. The return conduit from the evaporator flows against the conduit from the accumulator to provide the heat exchange relationship. This approach attempts to combine the liquid receiver function of the receiver with the accumulator needs amy from the evaporator. This art differs significantly from the purpose design in that the liquid leaving the condenser flow through a significant length of capillary tubing prior to being placed in heat exchange relationship with the suction line. This reduces the temperature and pressure of the liquid, creating an unacceptable level of subcooling when ambient conditions include lower temperatures but also making the liquid useless as a possible source of warm gas for defrost or harvest. No receiver is provided in the system to store a mass of warm liquid to supply warm flash gas as required by the proposed design. No pro@on is made or considered for supplying hot gas for defrost or harvest.

U.S. Pat. No. 2,895,306 awarded to Latter, 1957 calls for routing part of the refrigerant conduit from the condenser in heat exchange relationship against part of the return refrigerant conduit from the evaporator for the purpose of heating the portion of the return conduit which is exposed to the ambient above the dew point to prevent sweating of the suction line. This art differs significantly from the proposed design in that a capillary tube is used instead of a receiver and therefore, no provision of a source of flash gas is available. Since a capillary is placed immediately at the exit of the condenser, a receiver could not be placed in the system shown and still function as required in the proposed design, U.S. Pat. No. 2,907,181 awarded to Nomomaque, 1957 calls for routing the conduit in a different manner than that set forth in U.S. Pat. No. 2,895,306 (immediately above) but preserves the use of a capillary tube placed immediately at the exit of the condenser precluding the placement of a receiver in the system or the use of refrigerant for defrost or harvest. This art should be considered lacking due to inefficiencies in the same manner as others using a capillary tube design.

Disadvantage of the Conventional Arrangement

Generally, it might be said that the art suffers from attempts to introduce components to solve inherent inefficiency of the refrigerant while minimizing compressor failure. Still, compressor failures are a reality of the state of the art. In light of the failures, efficiency gains have become modest under the current state of the art, which gains are threatened to be wiped out as a result of requiring the use of modified, blended or substitute refrigerants, which by their chemical-physical properties, are less-efficient that the CFC/HCFC refrigerants.

There are several disadvantage inherent in conventional equipment currently available. The most critical risk of liquid entering the compressor is minimized by sacrificing efficiency for safety. The liquid level in the evaporator is kept below a level of flooding to minimize spillover from the evaporator. Also, suction accumulator function is required and often implemented either by adding coils to the suction accumulator as an additional heat exchange surface or by introducing a separate heat exchanger or all three, each of which is a source of inefficiency either due to pressure reduction or natural resistance thereby increasing the work which the compressor must do to return a given amount of suction gas to the system. The traditional employment of a heat exchanger provides a necessary source of super heating to the liquid being introduced to the evaporator but variants in the load or demand allow excess superheating which limits the amount of heat to be absorbed by the liquid refrigerant in the evaporation process. The process of having and defrosting is itself a balancing of the need for heat to clear the exterior of the evaporator as well as the desire to minimize unnecessary introduction of heat. In addition, the harvesting/defrosting cycle creates a period where the system must recycle and heat exchange while traditionally no refrigerant is flowing to the heat exchanger. Thus, in a period where exists the greatest risk of liquid slugs reaching the compressor, the heat exchanger (a part of the process for cleaning up the suction line) is not operational. This risk continues even while the system returns to its operational cycle as the liquid backing up in the evaporator limits the flow of incoming high-pressure liquid through the heat exchanger mounted upstream. Additionally, it should be noted that use of gas bled from the receiver (flash gas) while allowing faster harvest/defrost, allows subcooling of the remaining liquid within the receiver further limiting the efficiency of the evaporator without continued heat exchange.

Two methods are used to produce a throttling of the cycle, in addition to on-off controls, to maximize efficiency under variant loads. Each suffers from its own shortcomings. Capillary tubes are used to hold liquid refrigerant which backs up in the system when the evaporation rate drops off. The capillary tube design offers simplicity over a mechanical throttling device but suffers from lower efficiency and a limited capacity to handle widely divergent load. Also, the design can not offer a hot liquid feed for harvest/defrost. Harvest/defrost must either use a hot gas feed directly from the compressor, which places a higher load on the evaporator and hence a longer recovery period or produce some external heat source which is inherently less efficient. Thermal expansion devices have been implemented in larger systems where the complexity is less of a concern but the prevalent design of locating the heat exchanger directly upstream of the thermal expansion device prevents continued heat-expansion at a constant rate when the system throttles down. Thus, the heat exchanger must be oversized to accomplish heat exchange during periods of throttling d@. This allows excess superheating of the liquid refrigerant which is not optimally efficient.

SUMMARY OF THE INVENTION

The refrigeration system of the preferred embodiment utilizes inverted parallel flow cross piping "IPFX" to effect unexpected efficiency in the refrigerant system. The preferred embodiment includes a refrigerant evaporator, for example, of the type to manufacture ice, freezing or cooling of a space or its content to a lower value than that of the surrounding space, a refrigerant condenser, either water or air, which rejects the heat absorbed within the refrigerant evaporator, a refrigerant receiver providing for selective operation of the refrigerant evaporator in either a freezing, cooling or defrost cycle, a refrigerant thermal expansion deice, a refrigerant suction heat exchanger, a vapor-compression type refrigerant compressor.

The preferred embodiment of the refrigeration system of the present invention includes a compressor delivering refrigerant under pressure and a refrigerant condenser wherein heat (energy) contained within the refrigerant is rejected to the ambient. A first refrigerant conduit provides for refrigerant flow from the high pressure (output) side of the refrigerant compressor to the refrigerant condenser. A heat exchanger, being a vessel constructed with internal tubing mounted vertically in a straight or coiled configuration within a vertically oriented outer vessel allows for controlled transfer of heat in an area of interface situated between the first to second refrigerant conduit and the sixth to seventh refrigerant conduit. The heat exchanger is constructed to allow vertical installation such that inlets for both high pressure and low pressure conduits (second and seventh, respectively are at the bottom of the heat exchanger and that outlets for the high pressure and low pressure conduits (third and eighth, respectively) are at the top of the heat exchanger such that the flow of refrigerant for both high pressure and low pressure conduits is ascending. A second refrigerant conduit provides for refrigerant flow from the refrigerant condenser to the bottom inlet of the refrigerant heat exchanger. A refrigerant receiver provides a vessel for the accumulation of warm liquid refrigerant under high pressure. A third refrigerant conduit provides for refrigerant flow from the top output of the refrigerant heat exchanger to the refrigerant receiver. An evaporator with a expansion valve or vented at its inlet is provided to initiate vaporization of the refrigerant. A thermal expansion valve serves as a throttling means to control the flow of refrigerant into the evaporator. A fourth refrigerant conduit providing for refrigerant flow from the refrigerant receiver to the refrigerant thermal expansion device. A fifth refrigerant conduit provides for refrigerant flow from the refrigerant thermal expansion device to the high pressure (inlet) side of the refrigerant evaporator. A suction accumulator defines a vessel for accumulating low pressure gaseous refrigerant.

A sixth refrigerant conduit providing for refrigerant flow from the low pressure (output) side of the evaporator to the suction accumulator. A seventh refrigerant conduit proving for refrigerant flow from the suction accumulator to the bottom inlet to the suction heat exchanger. Finally an eighth refrigerant conduit provides for refrigerant flow from the top output of the suction heat exchanger to the low pressure (inlet) side of the compressor. Moreover, a heat exchange device is located in heat exchange relationship with the refrigerant flow in the conduit from the seventh to eighth refrigerant conduit, constructed to cause a vertical flow and heat exchange of the internal conduit in parallel flow with the second refrigerant conduit.

The implementation of the design is a novel routing of that circuitry together with a novel design of a heat exchanger and method of using same. Beginning with the compressor, refrigerant under pressure and in a gaseous form flows to a condenser where it rejects heat and condenses to a liquid, still under pressure. From the condenser, the liquid refrigerant is directed through the heat exchanger constructed and oriented in such a manner that the refrigerant enters the bottom and travels upwards, under pressure where it absorbs heat from the low pressure refrigerant leaving the evaporator so as to bring it closer to the temperature necessary for evaporation. The refrigerant flowing from the evaporator also enters the bottom of the heat exchanger such that the low pressure evaporated refrigerant and the high pressure condensed refrigerant travel in a parallel flow so as to maximize the constant level of heat exchange. From the heat exchanger, the liquid refrigerant still under pressure, flows to the receiver where it maintains its heating and pressure, such that evaporation does not condense, for purposes of holding that refrigerant to maintain the constant level of liquid within the evaporator. The evaporator is operated at a higher level of liquid than previously allowed (resulting in the higher efficiency since it is the liquid refrigerant which absorbs heat promoting cooling. The receiver allows the evaporator to cycle on and off for purposes of harvest and defrost without affect the flow of liquid refrigerant from the compressor through the heat exchanger. The liquid within the evaporator vaporizes and by that process, absorbs heat from the ambient, prompting cooling. The gaseous refrigerant flows out of the evaporator to the heat exchanger where heat absorbed can be partially rejected to superheat the liquid refrigerant flowing from the compressor. The gaseous refrigerant enters the bottom of the heat exchanger where it flows upward transferring heat but also allowing any liquid droplets to fall back and pool at the bottom of the heat exchanger. Additionally, liquid oil collected on the surface of the refrigerant pooling at the bottom of the heat exchanger and both the minimal liquid and the oil introduced for lubricating purposes are evaporated by the incoming flow of gaseous refrigerant thereby causing all refrigerant to be vaporized. The flow from the top of the heat exchanger can be routed to a suction accumulator prior to flowing to the heat exchanger or optionally the heat exchanger may serve the accumulator function. In either approach, liquid cannot flow upwards out from the heat exchanger to the compressor thus minimizing the possiblity of compressor failure.

While the principle of refrigeration is fairly straightforward, evolution of the prior arts shows both the nature of inefficiencies and difficulties within the principle of refrigeration and those arising due to application of modern refrigerants. Accordingly, the primary objectives of the present invention is the development of a system which maximizes the absorption of heat for a given expenditure of energy (efficiency), and which minimizes the risks of introducing liquid to the compressor which causes compressor failure and permits leakage of the refrigerant (safety). Prior arts reflect attempts to balance and compromise these two objectives. With an understanding of the risk of compressor failures due to liquid entering the compressors, prior arts have almost universally reduced efficiency as a safeguard. Given the potential for liquid escaping the evaporator, conventional approaches have both reduced the level of liquid in the evaporator and implemented throttling methods which maintain that reduced level. This approach fails in the modern am of limited energy resources, Advantages of the proposed design include the ability to achieve near maximum efficiency by using a novel design to avoid compressor failure.

It is the proposed configuration which, for the first time, provides a reliable method of precluding the flow of liquid to the compressor. This design achieves the object even where the flow through the evaporator has been reduced either due to throttling down or harvest/defrost cycling since the liquid backs up in the receiver but continues to allow flow of the high-pressure liquid to the heat exchanger situated upstream. An particular object during harvest/defrost is use of heated refrigerant within the system without the subcooling caused by bleeding gas off from the receiver (gas being formed when the receiver is vented to direct warm liquid to the evaporator).

An additional object of the design is to provide a heat source for either harvesting or defrosting the evaporator without the need for an independent heat source.

Another object of the design is to allow for efficiency under variant loads and demands while minimizing compromises to efficiency without sacrificing safety.

Another prominent object of the design is to provide simpler use and layout of necessary components to aid in both cost reductions and design flexibility. Further objects and advantages of the proposed design will manifest themselves upon consideration of the drawings, descriptions and application of the design.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
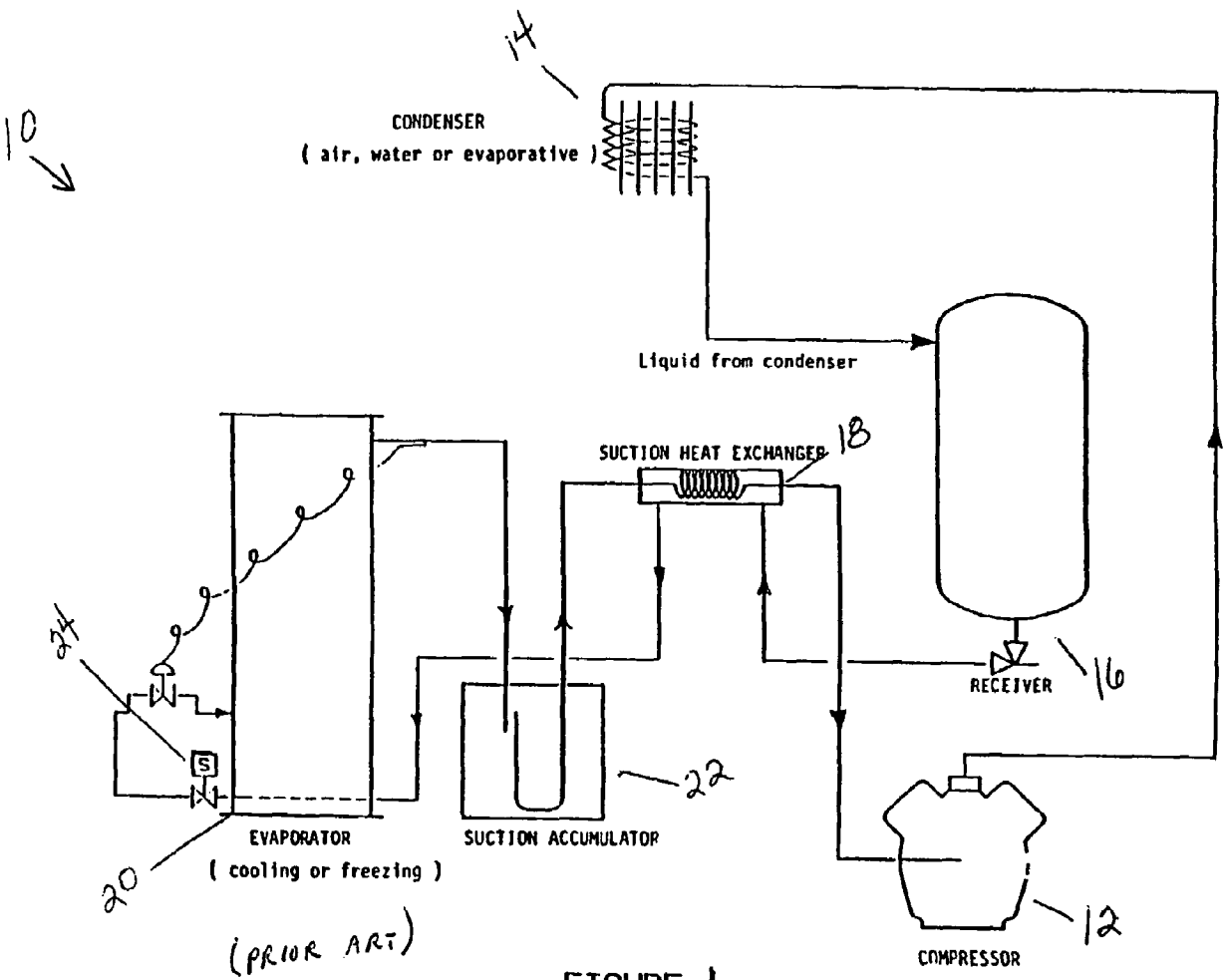
FIGURE 1 (PRIOR ART)
FIG. 1 shows a prior art embodiment outlining the method used in traditional prior arts to route refrigerant from the Compressor 12 to the condenser 14 where the liquid is collected in a receiver 16. When the system is operational, the liquid flows from the receiver 16 through a heat exchanger 18 to the evaporator 20 past a thermal expansion valve where, by becoming gaseous, it absorbs heat. The gas, now under low pressure, flows from the evaporator 20 to a suction accumulator 22 which holds liquid droplets contained in the suction gas from returning to the compressor. The suction gas flows from the suction accumulator 22 through the heat exchanger 18 where it transfer heat to the high presents liquid. This drawing includes a throttling mechanism 24 which limits liquid introduced to the evaporator 20.
Figure 2:
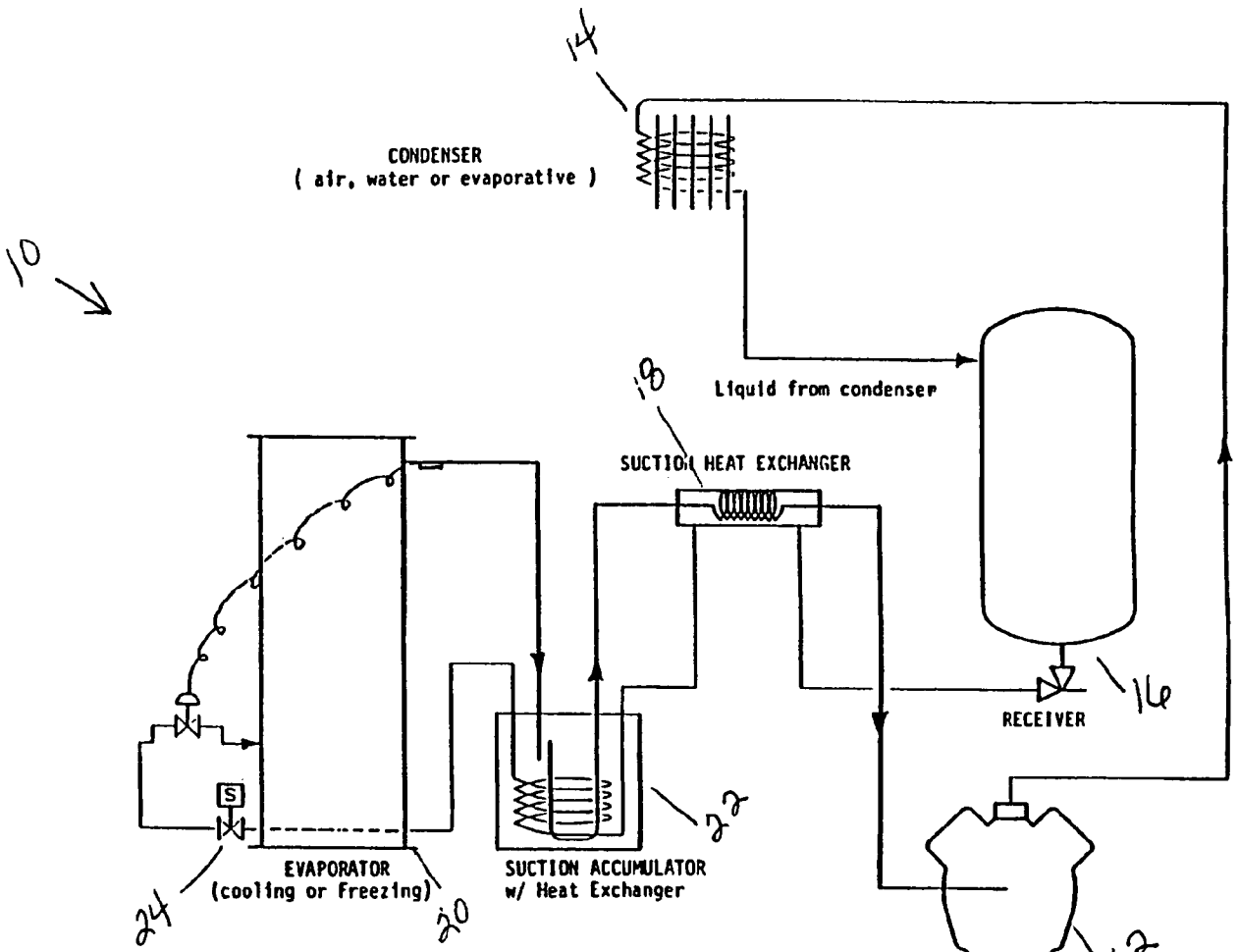
FIGURE 2 (PRIOR ART)
FIG. 2 introduces a second heat exchange function contained within the suction accumulator 20 but is otherwise similar to FIG. 1. This second heat exchanger allows a more controlled level of heat introduced to the refrigerant flow entering the evaporator 22 as such superheating promotes evaporation.
Figure 3:
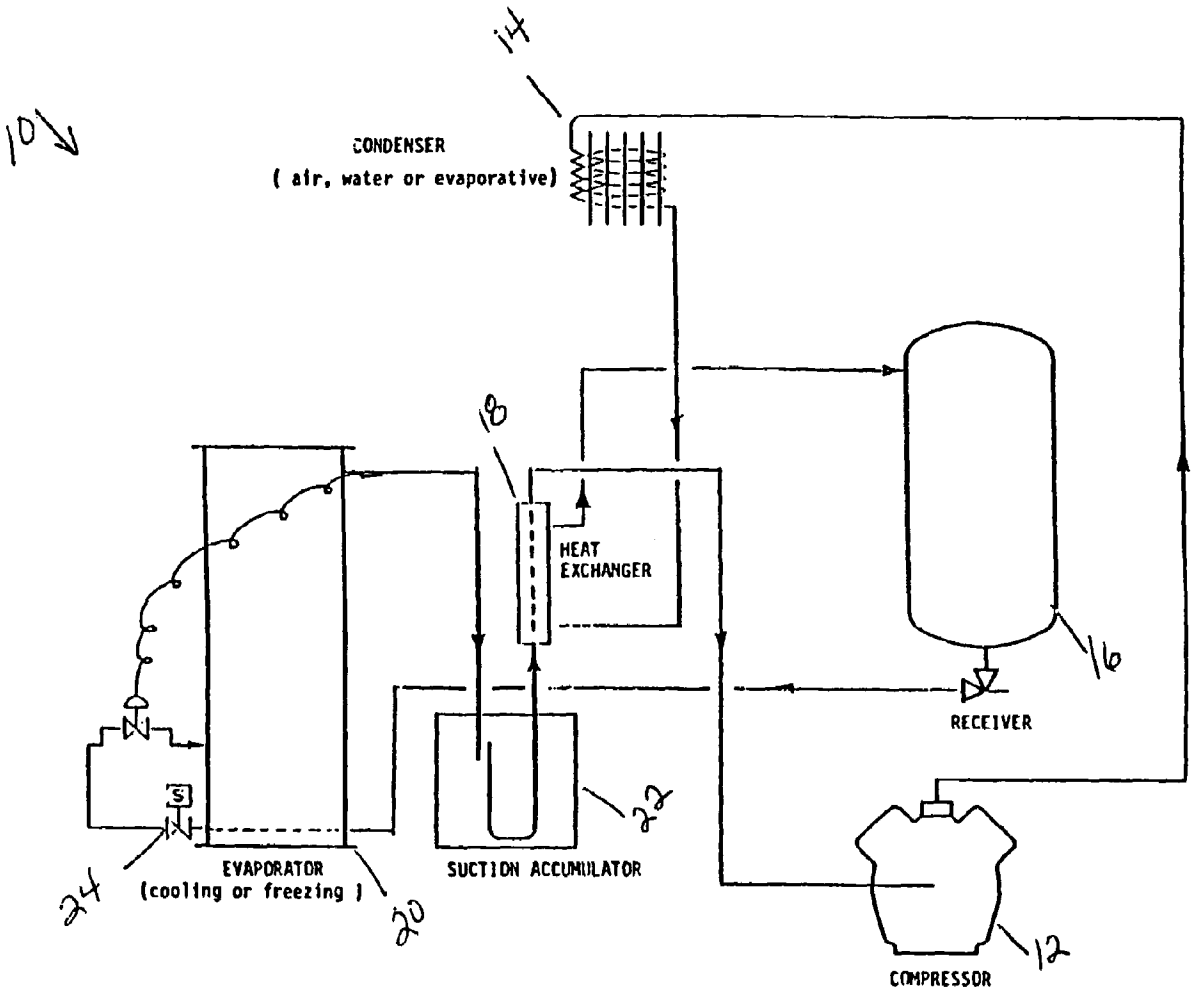
FIG. 3 introduces the inverted parallel flow cross piping design wherein the refrigerant flow from the Compressor 12 to the condenser 14 where the liquid first flows through the heat exchanger 18 prior to its collection in the receiver 16. The warmed liquid refrigerant flows from the receiver 16 directly to the evaporator 20 past a thermal expansion valve where it absorbs heat. The gas now under low pressure flows from the evaporator (El through the suction accumulator 22 to the heat exchanger 18 prior to returning to the compressors). This drawing discloses the layout of the proposed design and suggests the vertical configuration of the heat exchanger and the parallel paths of refrigerant contrary to prior arts.
Figure 4:
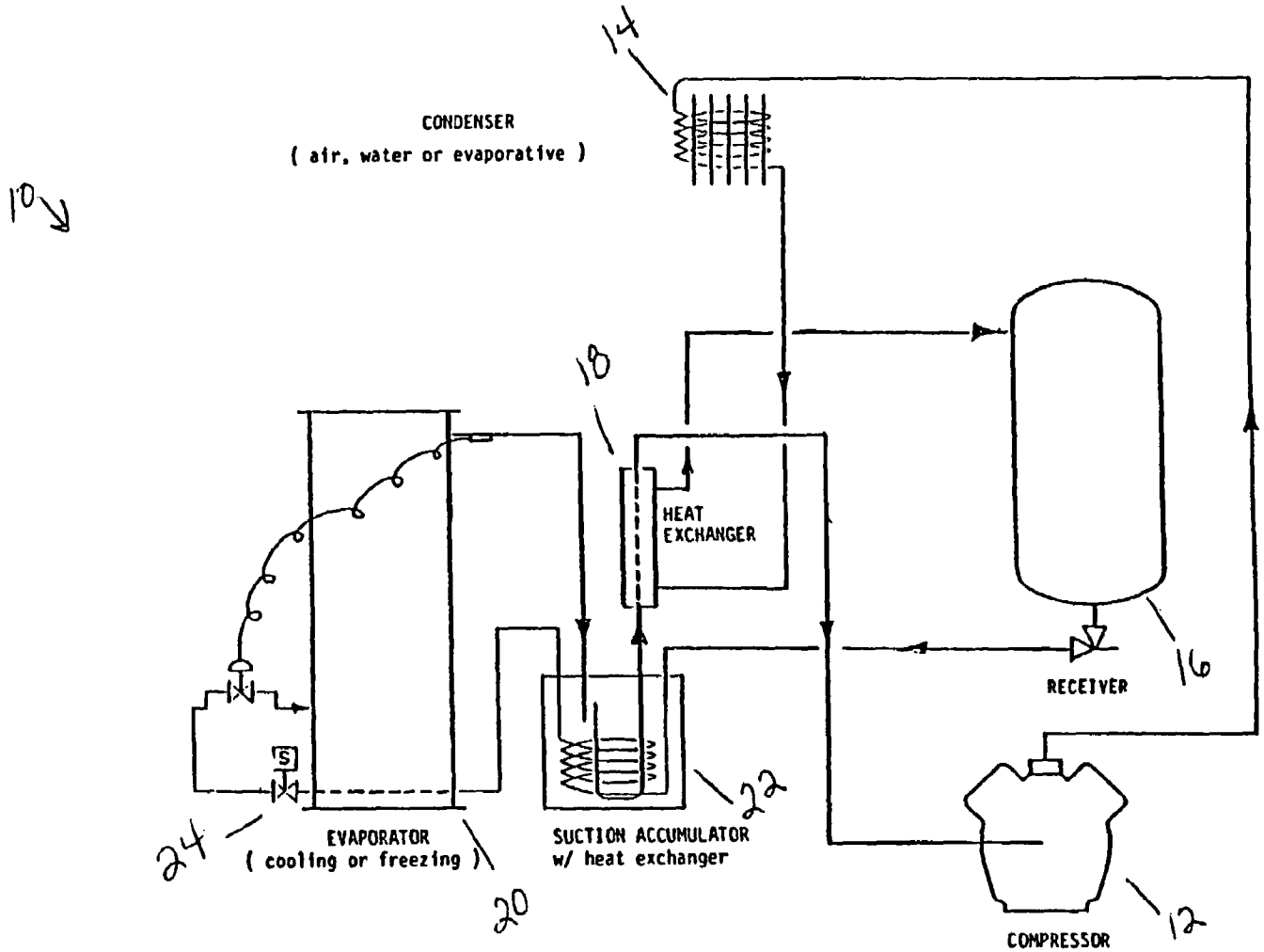
FIG. 4 introduces a second heat exchange function contained within the suction accumulator 20 in the same manner Ural this alternate approach (as to secondary heat exchange) is found in the present arts and disclosed in FIG. 2.
Figure 5:
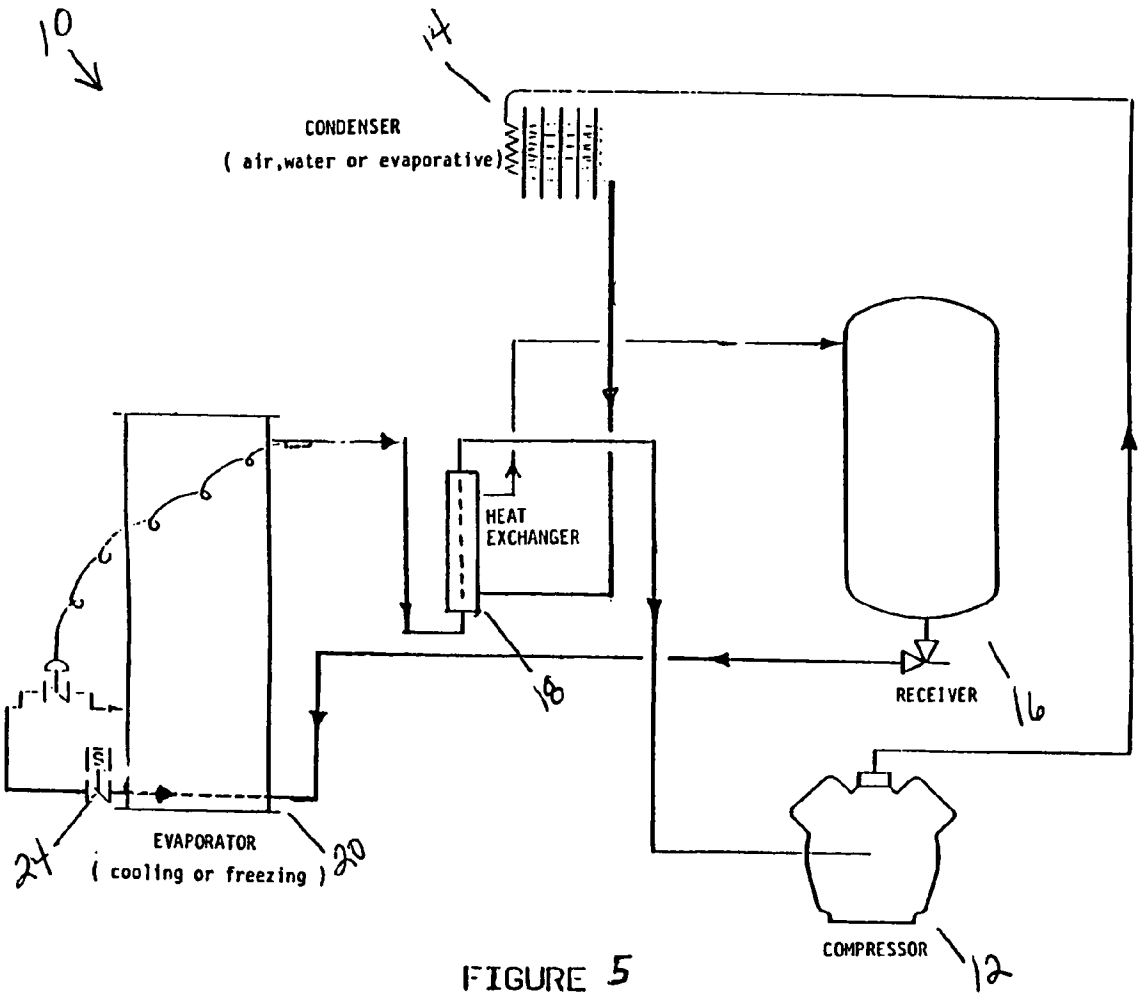
FIG. 5 introduces a design whereby the heat exchanger provides the function otherwise served by the suction accumulator and hence a separate suction accumulator is not necessary.
Figure 6:
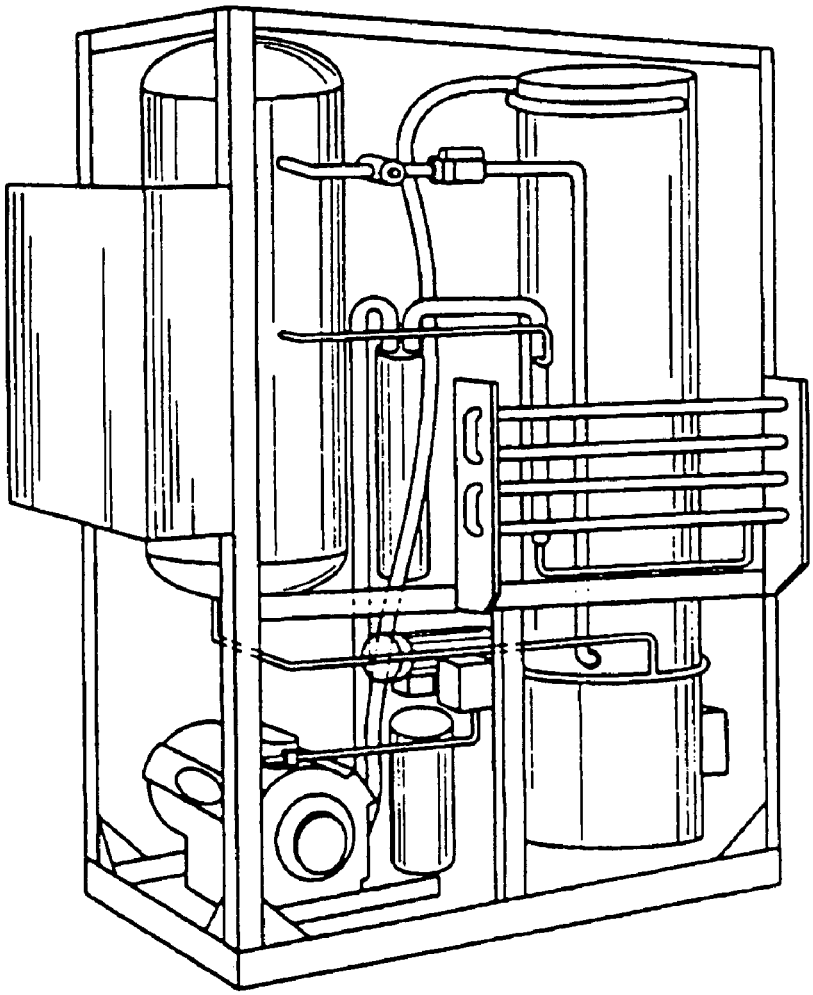
FIG. 6 shows an ice making refrigeration unit utilizng the inverted parallel flow cross piping design.
Figure 7:
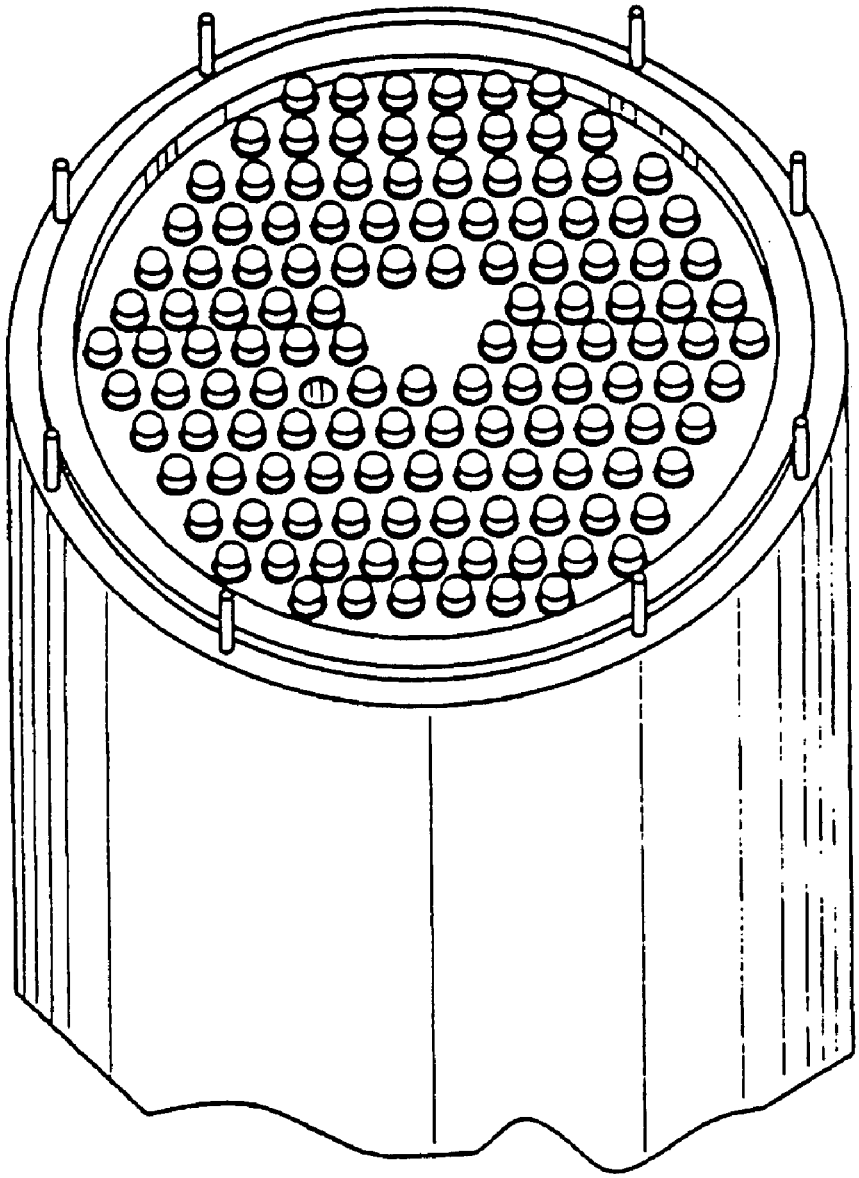
FIG. 7 shows the top of the evaporator showing tubes in which the ice is formed therein.
Figure 8:
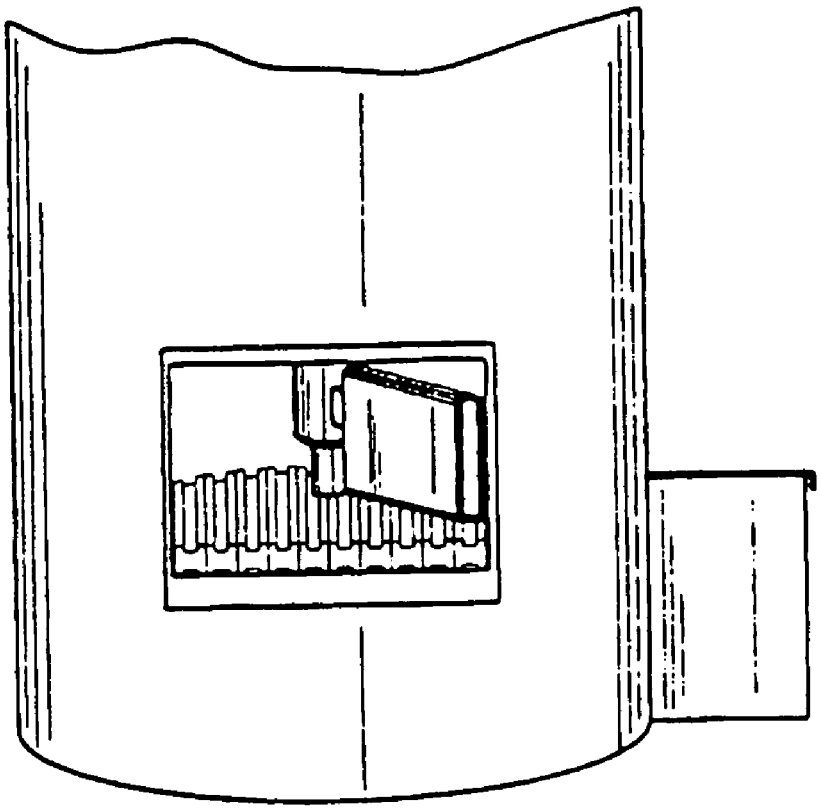
FIG. 8 shows the bottom of the evaporator wherein the ice tubes are cut into segments.

The proposed design is that circuitry of conduit which controls and directs the flow of refrigerant within the apparatus constituting a refrigeration system as depicted in FIGS. 3–5 utilizing inverted parallel flow cross piping "IPFX" to effect unexpected efficiency in the refrigerant system.

The preferred embodiment of the refrigeration system of the present invention includes a compressor delivering refrigerant under pressure and a refrigerant condenser wherein heat (energy) contained within the refrigerant is rejected to the ambient. A first refrigerant conduit provides for refrigerant flow from the high pressure (output) side of the refrigerant compressor to the refrigerant condenser. A heat exchanger, being a vessel constructed with internal tubing mounted vertically in a straight or coiled configuration within a vertically oriented outer vessel allows for controlled transfer of heat in an area of interface situated between the first to second refrigerant conduit and the sixth to seventh refrigerant conduit. The heat exchanger is constructed to allow vertical installation such that inlets for both high pressure and low pressure conduits (second and seventh, respectively are at the bottom of the heat exchanger and that outlets for the high pressure and low pressure conduits (third and eighth, respectively) are at the top of the heat exchanger such that the flow of refrigerant for both high pressure and low pressure conduits is ascending. A second refrigerant conduit provides for refrigerant flow from the refrigerant condenser to the bottom inlet of the refrigerant heat exchanger. A refrigerant receiver provides a vessel for the accumulation of warm liquid refrigerant under high pressure. A third refrigerant conduit provides for refrigerant flow from the top output of the refrigerant heat exchanger to the refrigerant receiver. An evaporator with a expansion valve or vented at its inlet is provided to initiate vaporization of the refrigerant. A thermal expansion valve serves as a throttling means to control the flow of refrigerant into the evaporator. A fourth refrigerant conduit providing for refrigerant flow from the refrigerant receiver to the refrigerant thermal expansion device. A fifth refrigerant conduit provides for refrigerant flow from the refrigerant thermal expansion device to the high pressure (inlet) side of the refrigerant evaporator. A suction accumulator defines a vessel for accumulating low pressure gaseous refrigerant. A sixth refrigerant conduit providing for refrigerant flow from the low pressure (output) side of the evaporator to the suction accumulator. A seventh refrigerant conduit proving for refrigerant flow from the suction accumulator to the bottom inlet to the suction heat exchanger. Finally an eighth refrigerant conduit provides for refrigerant flow from the top output of the suction heat exchanger to the low pressure (inlet) side of the compressor. Moreover, a heat exchange device is located in heat exchange relationship with the refrigerant flow in the conduit from the seventh to eighth refrigerant conduit, constructed to cause a vertical flow and heat exchange of the internal conduit in parallel flow with the second refrigerant conduit.

An alternate embodiment of the refrigerant system includes a suction accumulator containing coiling such that refrigerant flow of the fourth refrigerant conduit is placed in a secondary heat exchange relationship to the refrigerant flow of the sixth refrigerant conduit within the said suction accumulator. This design allows installation of a suction accumulator with or without high pressure liquid coil within the fourth refrigerant conduit.

The preferred embodiment of the refrigerant system may also optionally include a by-pass of a suction accumulator such that the refrigerant flow of the sixth refrigerant conduit from the evaporator flows directly to the heat exchanger allowing operation without any suction accumulator because the heat exchanger installed in the proposed manner serves to accomplish the same function as the suction accumulator.

The refergerant system may also use any manner of condenser (air, water or evaporative) and any manner of evaporator (for cooling or freezing).

The refrigerant systems may also provide for the parallel flow of refrigerants from the receiver to the evaporator and from the evaporator to the compressor in a vertical environment for heat exchange in a manner providing for accumulation of liquid present in the low pressure refrigerant conduit obviating any need for further collection of liquid before or within the compressor.

Where a refrigerating system requires hot gas harvest or defrost, the refrigerant systems described heretofor may include a secondary conduit for drawing warm liquid for defrost or harvest directly from the receiver rather than using hot gas from compressor discharge without sacrificing integrity of the proposed design.

The implementation of the design is a novel routing of that circuitry together with a novel design of a heat exchanger and method of using same. Beginning with the compressor, refrigerant under pressure and in a gaseous form flows to a condenser where it rejects heat and condenses to a liquid, still under pressure. From the condenser, the liquid refrigerant is directed through the heat exchanger constructed and oriented in such a manner that the refrigerant enters the bottom and travels upwards, under pressure where it absorbs heat from the low pressure refrigerant leaving the evaporator so as to bring it closer to the temperature necessary for evaporation. The refrigerant flowing from the evaporator also enters the bottom of the heat exchanger such that the low pressure evaporated refrigerant and the high pressure condensed refrigerant travel in a parallel flow so as to maximize the constant level of heat exchange. From the heat exchanger, the liquid refrigerant still under pressure, flows to the receiver where it maintains its heating and pressure, such that evaporation does not condense, for purposes of holding that refrigerant to maintain the constant level of liquid within the evaporator. The evaporator is operated at a higher level of liquid than previously allowed (resulting in the higher efficiency since it is the liquid refrigerant which absorbs heat promoting cooling. The receiver allows the evaporator to cycle on and off for purposes of harvest and defrost without affect the flow of liquid refrigerant from the compressor through the heat exchanger. The liquid within the evaporator vaporizes and by that process, absorbs heat from the ambient, prompting cooling. The gaseous refrigerant flows out of the evaporator to the heat exchanger where heat absorbed can be partially rejected to superheat the liquid refrigerant flowing from the compressor. The gaseous refrigerant enters the bottom of the heat exchanger where it flows upward transferring heat but also allowing any liquid droplets to fall back and pool at the bottom of the heat exchanger. Additionally, liquid oil collected on the surface of the refrigerant pooling at the bottom of the heat exchanger and both the minimal liquid and the oil introduced for lubricating purposes are evaporated by the incoming flow of gaseous refrigerant thereby causing all refrigerant to be vaporized. The flow from the top of the heat exchanger can be routed to a suction accumulator prior to flowing to the heat exchanger or optionally the heat exchanger may serve the accumulator function. In either approach, liquid cannot flow upwards out from the heat exchanger to the compressor thus minimizing the possiblity of compressor failure.

Use of the proposed design allows maximum liquid levels to be maintained within the evaporator which in turn maximizes the absorption of heat. Absorption of heat is a direct function of available liquid refrigerant within the evaporator. Absorption is also an indirect function of superheat of the refrigerant as superheating of the refrigerant reduces the ability of the refrigerant to absorb additional heat from the ambient medium. Efficiency may be viewed as a direct function of maximizing liquid within the evaporator and an indirect function of superheat carried into the evaporator for a given expenditure of energy (via the compressors to maintain the cycle. Therefore, the proposed design, by maximizing liquid levels and minimizing superheat within the evaporator, provides a more efficient refrigeration method using refrigerants available under both environmental-friendly requirements and non-environmental-friendly conditions.

Applying the heat exchange relationship in a vertical arrangement of the proposed design, rather than a traditional horizontal arrangement, eliminates escape of residual liquid, ordinarily present in the evaporated refrigerant vapor, towards the compressor. This eliminates the need for a separate suction accumulator which is a reduction in required components.

Applying the heat exchange relationship in a vertical arrangement of the proposed design, rather than a traditional horizontal arrangement, also eliminates the need for a separate suction accumulator which as a vessel contained in the system is a point for pressure reduction which creates inefficiency by reducing the amount of refrigerant compressed by the compressor for each given stroke/cycle. For each given compressor stroke/cycle compressing a volume of refrigerant, the reduction of density translates to a corresponding reduction in refrigerant mass delivered to the evaporator where R will eventually absorb heat as is the goal of the system.

Applying fine heat exchange relationship in a parallel flow arrangement allows for a longer and more gradual exchange of heat rather than the traditional arrangement of counter-flowing suction gas and condensed liquid towards each other. The traditional approach requires sizing the heat-exchanging medium to compensate for the less-efficient arrangement whereas the proposed design allows reduced sizing of this item of componentry. This provides both a corresponding reduced cost of production and an increased amount of design flexibility.

Applying the heat exchange relationship in a parallel flow arrangement, coupled with a receiver placed downstream, allows for a more consistent heat-exchange relationship regardless of the throttling function required due to variant loads and demands on the system. This constant exchange of heat allows better sizing of the evaporator since the risk of subcooling is minimized.

The use of the design allows higher density of suction gas output from the evaporator due to the minimized pressure-reducing volumetric changes in the conduit to the compressor. This, in turn, allows higher compression per given stroke/cycle or a more efficient use of the energy expended to cause that stroke/cycle.

The use of the design, by minimizing the possibility of introduction of liquid refrigerant to the compressor, nearly eliminates the risks of slugging the compressor, a significant cause of compressor failure. In addition to an obvious reduction in maintenance costs, reductions of compressor failure reduce the possibility of exposure of refrigerants to the environments. Where refrigerants have deemed to be an environmental hazardous material, this risk of failure induced leakage is of supreme importance.

Flow of warm liquid through the suction heat exchanger or suction accumulator is established immediately after the system switches from harvest to defrost to pull down, which flowing warm liquid is 20° F. to 40° F. warmer than the liquid stored in the receiver at that time. Maximum compressor protection is maintained by using a source of warm liquid for suction clean up that is the highest quantity available and highest temperature available. The quantity of flash gas available from the receiver during harvest is not adversely affected since the warm liquid is only sub-cooled by 2° F. to 10° F. in the suction heat exchanger before it reaches the receiver.

Figure 9:
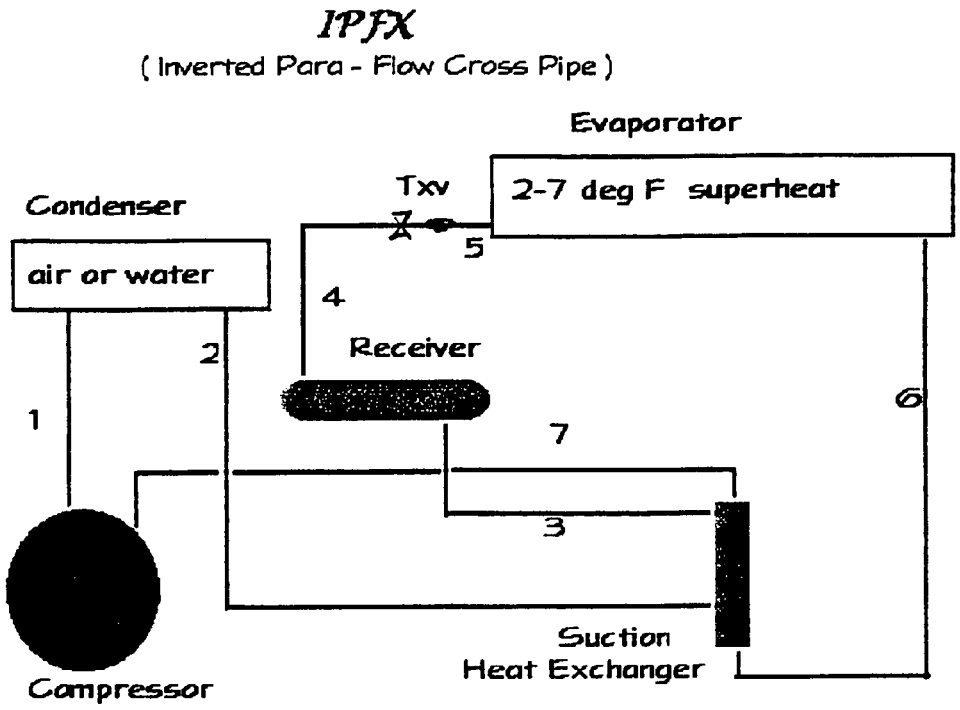
FIG. 9 illustrates a flow diagram showing the flow of refrigerant starting at the compressor discharge for an inverted para-flow cross pipe system.
Figure 10:
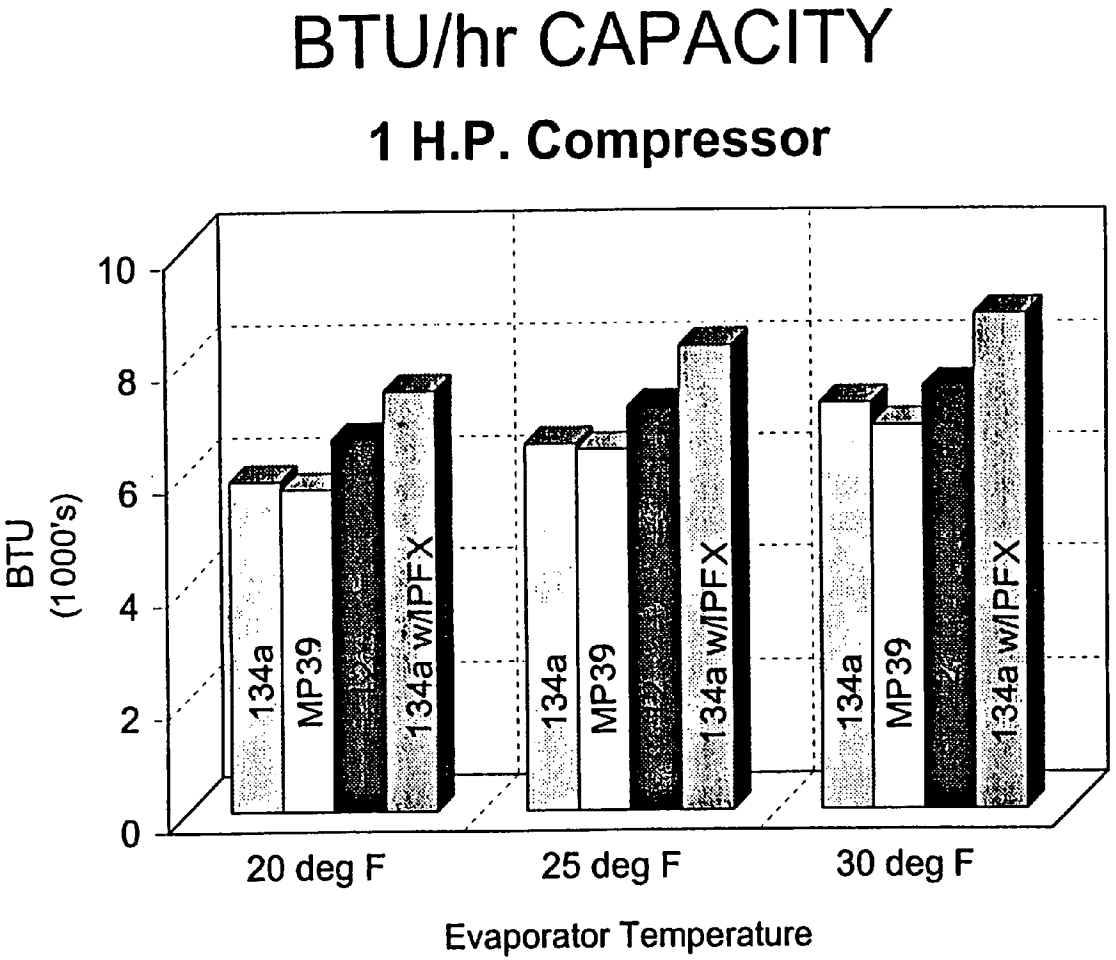
FIG. 10 shows a bar graph for a 1 hp compressor comparing conventional evaporation temperature with various coolants as compared with an inverted para-flow cross pipe system.
Figure 11:
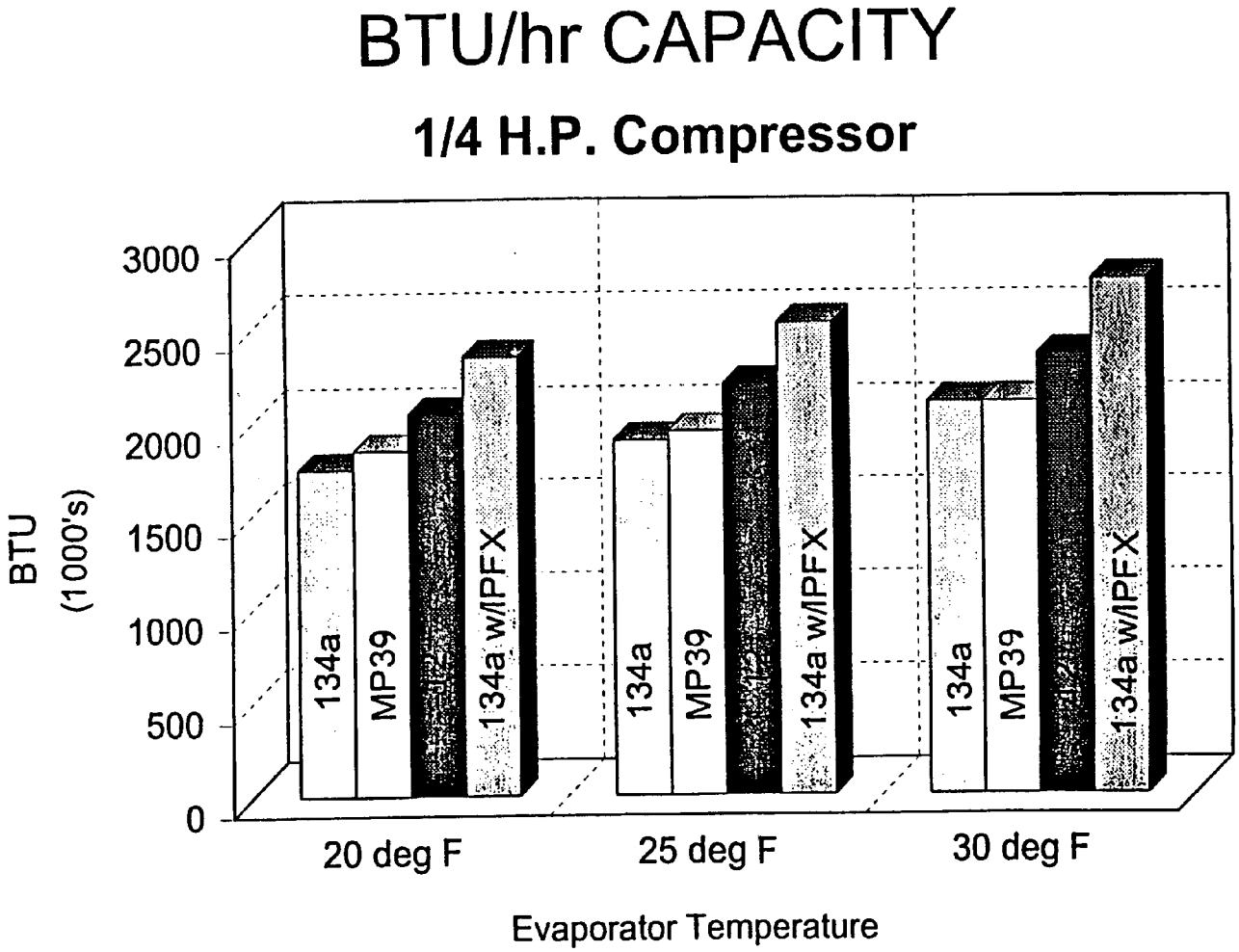
FIG. 11 shows a bar graph for a 1 hp compressor comparing conventional evaporation temperature with various coolants as compared with an inverted para-flow cross pipe system.

FIGS. 9–11 detail a basic refrigeration system with all the necesary components to control pressure, temperature and preventive components to eliminate liquid refrigerant exposure to the compressor. What is demonstrated through the schematic and graphs is that the alternate blend refrigerants (134a and MP-39) are far more less efficient than Refrigerant 12, noting that these alternate blends are the direct replacement/dropins for Refrigerant-12, which is a CFC and is no longer being manufactured per the U.S. Government (EPA) and the Montreal Protocol Act.

FIGS. 10 and 11 are graphs (BTU) which demonstrate the capacity of various horsepower ratings at (3) of the more commonly used evaporator temperatuers, using (3) of the more commonly used refrigerants. These graphs are generated from actual data supplied by compressor manufacturers. FIG. 10 represents a 1 horsepower refrigeration system and FIG. 11 represents a ¼ horsepower refegeration system.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims.

I claim:

1. A refrigeration system, comprising:

a compressor;

a condenser for transferring heat from high pressure refrigerant flowing therethrough to the surrounding ambient, said condenser having an inlet being in fluid communication with an outlet of said compressor through a first conduit;

a heat exchanger for transferring heat from low pressure refrigerant flowing therethrough to high pressure refrigerant flowing therethrough, said heat exchanger having a high pressure inlet being in fluid communication with an outlet of said condenser through a second conduit;

a receiver, said receiver having an inlet being in fluid communication with a high pressure outlet of said heat exchanger through a third conduit;

an expansion valve having an inlet being in fluid communication with an outlet of said receiver through a fourth conduit;

an evaporator for transferring heat from a refrigerated space to low pressure refrigerant flowing through said evaporator, said evaporator having an inlet being in fluid communication with an outlet of said expansion valve through a fifth conduit;

an accumulator having an inlet being in fluid communication with an outlet of said evaporator through a sixth conduit;

said heat exchanger having a low pressure inlet being in fluid communication with an outlet of said accumulator through a seventh conduit, said compressor having an inlet being in fluid communication with a low pressure outlet of said heat exchanger through an eighth conduit; wherein, high pressure refrigerant flowing through said heat exchanger from said high pressure inlet thereof to said low pressure outlet thereof is in ascending parallel flow relation to low pressure refrigerant flowing through said heat exchanger from said low pressure inlet thereof to said low pressure outlet thereof.

2. The refrigeration system of claim 1, wherein said fourth conduit passes through said accumulator to permit transfer of heat from low pressure gaseous refrigerant in said accumulator to high pressure refrigerant flowing through said fourth conduit.

3. The refrigeration system of claim 1, further comprising a by-pass having an inlet being in fluid communication with said sixth conduit and an outlet being in fluid communication with said seventh conduit, wherein said by-pass is moveable between a closed position and a flow-through position, and wherein low pressure refrigerant flows through said by-pass when said by-pass is in said flow-through position.

4. The refrigeration system of claim 1, further comprising a secondary conduit for drawing high pressure refrigerant from said receiver around said evaporator to permit harvesting of ice thereon.

5. The refrigeration system of claim 1, wherein said high pressure inlet of said heat exchanger is vertically below said high pressure outlet of said heat exchanger, and wherein said low pressure inlet of said heat exchanger is vertically below said low pressure outlet of said heat exchanger.

* * * * *